United States Patent [19]

Jaros et al.

[11] 4,067,182

[45] Jan. 10, 1978

[54] METHOD OF AND APPARATUS FOR SEPARATING STAPLE FIBERS FROM A FIBROUS SLIVER

[75] Inventors: Frantisek Jaros; Zdenek Kotrba; Josef Ripka, all of Usti nad Orlici; Vaclav Vobornik, Lethorad; Jan Junek, Usti nad Orlici; Vladimir Ohlidal, Usti nad Orlici; Frantisek Hortlik, Usti nad Orlici; Marie Brozkova, Usti nad Orlici; Vera Zukovska, Brandys nad Orlici, all of Czechoslovakia

[73] Assignee: Vyzkumny ustav bavlnarsky, Usti nad Orlici, Czechoslovakia

[21] Appl. No.: 726,147

[22] Filed: Sept. 24, 1976

[30] Foreign Application Priority Data

Oct. 3, 1975 Czechoslovakia ..... 6709/75

[51] Int. Cl.[2] ..... D01H 1/12

[52] U.S. Cl. ..... 57/58.95; 57/156

[58] Field of Search ..... 57/58.89, 58.95, 34 R, 57/56, 156

[56] References Cited

U.S. PATENT DOCUMENTS

| | | | |
|---|---|---|---|
| 3,892,063 | 7/1975 | Doublebsky et al. | 57/58.95 X |
| 3,894,386 | 7/1975 | Sharychekov et al. | 57/58.95 |
| 3,922,839 | 12/1975 | Sakurai et al. | 57/58.95 |
| 3,938,310 | 2/1976 | Didek et al. | 57/58.95 X |

*Primary Examiner*—Donald Watkins

[57] ABSTRACT

A method of separating fibers from a fibrous sliver and conveying them in this condition to a twist forming element of an open-end spinning unit. The fibers traverse a fiber separating zone which is formed by the annular space between a combing-out cylinder and the bore of a housing. Ambient air is sucked into this fiber separating zone as well as into a sliver feeding zone. The air being sucked in is the resultant of air flowing in planes perpendicular to the axis of the combing-out cylinder, in planes passing through said axis and in planes parallel to said axis.

The apparatus for carrying out the aforedescribed method which includes a housing with a bore, a combing-out cylinder coaxially mounted in the bore, a sliver feeding device mounted in a cavity of the housing adjacent to the combing-out cylinder, and a lid covering the housing, but at least the region of the sliver feeding device being at least partially exposed to permit ambient air to be sucked into the sliver feeding and fiber separating zones.

6 Claims, 2 Drawing Figures

METHOD OF AND APPARATUS FOR SEPARATING STAPLE FIBERS FROM A FIBROUS SLIVER

BACKGROUND OF THE INVENTION

The present invention relates to a method of and an apparatus for separating fibers from a fibrous sliver and supplying them in this condition to a twist forming element of an open-end spinning unit, the fibers being exposed to a sucked-in air flow in the fiber separating zone having a combing-out cylinder.

There are known apparatus for open-end spinning yarns from staple fibers, which apparatus are characterized by a substantially higher productivity than the well-known ring spinning machines. Such open-end spinning machines of the first generation have operated at a spinning rotor speed of about 30,000 rpm. The second generation of these machines has already achieved speeds within the range of from 45,000 to 60,000 rpm. Recently, in the development of machines having still higher productivity, that is, machine operable within the spinning rotor speed range of about 100,000 rpm, there have been encountered certain problems in the operation of fiber separating devices of the type installed in the prior art machines having the aforementioned lower operating speeds, so that these devices have to be further improved.

A higher machine productivity makes for larger fiber amounts to be processed per unit of time and to be supplied in the separated condition to the high-speed spinning rotor. To meet requirement, it is necessary, on the one hand, to increase the velocity of fiber flow to be supplied to the spinning rotor and, on the other hand, to raise the effect of the combing-out cylinder upon the fibers and to reduce the contamination of the inner space as well as sliver inlet spaces of the fiber separating device. Such contamination in the lower output machines is practically irrelevant.

In the well-known open-end spinning machines, fibers having left the combing-out cylinder zone are accelerated by air flowing through a fiber supply duct. Preferably, relatively short ducts are used for this purpose since long ducts lay excessive claims on the manufacture thereof and are also disadvantageous from the power economy viewpoint. However, with a relatively short duct, even at a relatively high air throughflow velocity, it is impossible to achieve, owing to a short passage, a substantial acceleration of the fiber flow if fibers are supplied at a low velocity. Experiments in this field have proven that an average velocity of fibers, when stripped from the combing-out cylinder clothing, is lower than the circumferential speed of said clothing. This can be attributed to the fact that all the fibers, after having been separated, are not entrained by the active elements of the combing-out cylinder, but are, on the one hand, airborne through the interspace between the surface of the cylinder and the wall of the cavity receiving said cylinder, and, on the other hand, are braked or retarded by the contact with said wall. In the well-known open-end spinning machine constructions, the sliver inlet zone and the fiber separating zone are hermetically sealed off to prevent dust and other impurities from entering the spinning unit from the ambient atmosphere. This feature prevents, however, an air amount sufficient for conveying fibers through the combing-out cylinder region from being sucked in. If one considers that increased machine productivity is brought about by an ever increasing effect of the combing-out cylinder upon the fibers which causes the amount of fibers together with undesirable admixtures conveyed around the combing-out cylinder to increase, it becomes clear why those regions are insufficiently scavenged by air and thus get clogged.

To eliminate the aforedescribed disadvantage, various measures have been attempted to enable air to be supplied in limited amounts into various regions of the cavity accommodating the combing-out cylinder. However, such measures have proven rather complicated from the constructional viewpoint and, apart from that, are not completely efficient if used in highly productive open-end spinning machines. Moreover, in a construction having a cover above the feed roller, the roller front portion is fouled with dust and fiber fly in the form of stuffed clots which are densified, owing to the contact between the front of the rotating feed roller and the stationary cover wall.

To improve the cleaning of extra short fibers from the device, there has been provided a construction wherein air is supplied through a small opening in the direction perpendicular to the front of the feed roller. However, such a measure is not satisfactory for a universal cleaning purpose and its effect is limited to a close proximity of the mouth of said opening.

SUMMARY OF THE INVENTION

In order to eliminate the disadvantages of the prior art devices, as hereinabove set forth, there is provided an improved method of separating fibers from a fibrous sliver and supplying them in this condition to a twist forming element of an open-end spinning unit. The fibers are exposed in the fiber separating zone of a combing-out cylinder to a sucked-in air flow. The method, according to this invention, consists in that the fibers, in the sliver feeding zone and the fiber separating zone, are exposed to an air flow which is the resultant of air flows supplied in the planes perpendicular to the axis of the combing-out cylinder, in the planes passing through said axis and in the planes parallel to said axis. The amount of air supplied through inlet and front ports into the region of the sliver feeding device is from 10 – 70 percent of the total amount of air entering the whole region of the fiber separating device.

For carrying out the above method there has been provided an apparatus comprising a combing-out cylinder and a sliver feeding device accommodated in a cavity of the housing of the fiber separating device. The arrangement is provided at the front side with a lid, and is characterized, according to the invention, in that at least one of the front sides of the housing of the fiber separating device is, in the region of said feeding device, at least partially open for sucking in the air.

Preferably, at least one of the front sides of the housing is open within the whole region of the sliver feeding device. The sum of cross-sectional areas of the ports for sucking in air both from the front side of the housing and from the sliver inlet side is from 10 –70 percent of the total sum of the cross-sectional areas of all the air supplying channels of the fiber separating device.

In an alternate embodiment of the apparatus according to the invention, there is provided a lid above the sliver feeding device, said lid being recessed from below to allow the air to be sucked in. However, the lid can be formed in various manners. Thus, for example, it can be shorter than the front side of the housing so that the sliver feeding region remains uncovered from one side.

Either one or both sides of the housing of the fiber separating device can be arranged in this way. Alternatively, a portion of the front side of the housing can be provided with a screen, or with a similar element allowing the air access. Likewise, it is possible to arrange the sliver feeding device, wholly or partially, outside in front of the housing of the fiber separating device, or the like.

The principle of the present invention resides in that at least one front side of the housing of the fiber separating device, in the region of the sliver feeding device, is open to allow the access for air which positively influences the movement of fibers during the process of separating, and supplying them to the twist forming element of the open-end spinning unit. With the method of the invention, it is preferable that also the sliver inlet side of the fiber separating device, which means the side at which the sliver enters the fiber separating zone, be open to allow the free air access. Alternatively, it is possible to practice the invention even in those cases when the openings at the inlet side of the fiber separating device are sealed.

For controlling a required ratio between the air amounts supplied to the fiber separating device at the inlet side as well as through the frontal opening of the housing and the air amounts entering said device, it is preferable to provide the air inlet port of the fiber supply duct, e.g., at the lateral side of the housing, with a throttling baffle.

The method and apparatus according to the invention is particularly suitable to be used in open-end spinning machines with high-speed spinning rotors. The arrangement according to the invention enhances the effect of combing-out cylinder on the fibers, accelerates the flow of fibers supplied into the spinning unit and simultaneously reduces the degree of fouling of the interior as well as of the sliver inlet region of the spinning unit.

BRIEF DESCRIPTION OF THE DRAWING

In order that the invention be better understood and carried into practice, some preferred embodiments thereof will now be described with reference to the accompanying, somewhat schematic drawings which, however, are not intended to limit in any way the scope of the present invention.

In the drawing

DETAILED DESCRIPTION

Figure 1:
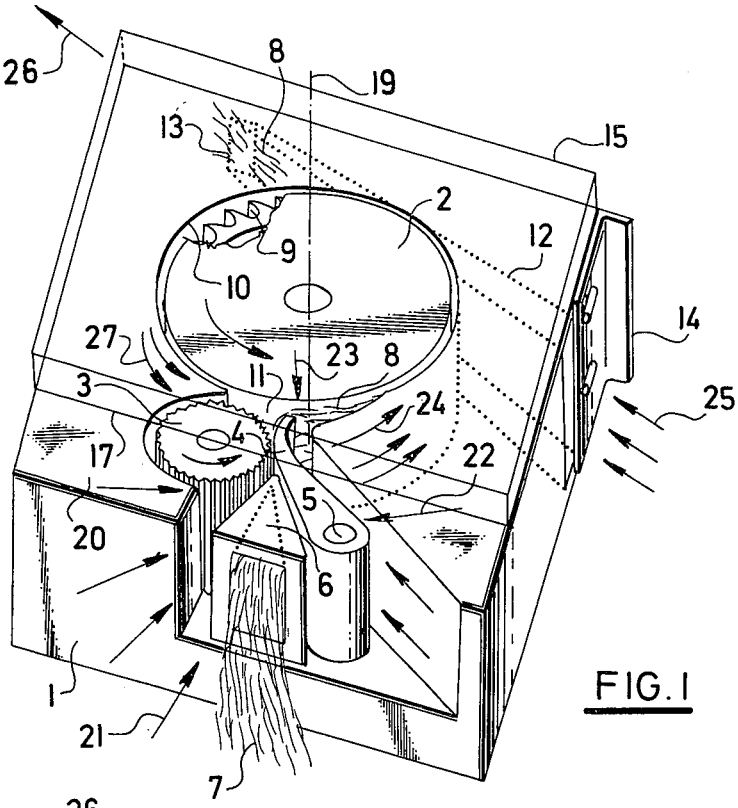
FIG. 1 is a perspective view of a first embodiment of the apparatus.

Referring to the drawing, and particularly to FIG. 1 thereof, it can be seen that in a cavity 10 provided in a housing 1 of the fiber separating device, a combing-out cylinder 2 with a sawtooth clothing 9 is accommodated. In a recess 11 of said housing 1, communicating with said cavity 10, there is arranged a fiber feeding device designed for feeding a fibrous sliver 7 to the combing-out cylinder 2 and comprising a feed roller 3, a pressure shoe 4 journalled about a pivot 5 and adapted to bear upon the feed roller 3, and a sliver condenser 6. Opposite the fiber feeding device, the cavity 10 communicates with a fiber supply duct 12. The intake port of the supply duct 12 at the lateral side of the housing 1 is provided with a throttling baffle 14. The opposite or outlet port 13 of the supply duct 12 communicates, at the outlet side of the housing 1, with a cavity receiving a twist forming device operable under subatmospheric pressure, such as, for example, a spinning rotor of the type illustrated is coassigned and copending application Ser. No. 516,909 filed Oct. 22, 1976 and entitled "Open-End Spinning Machine," (not shown). The housing 1 of the fiber separating device is covered at its front side 20 with a lid 15 (shown in phantom lines for sake of clarity (FIG. 1) which is somewhat shorter than said front side 20 so that the feed roller 3 and the pressure shoe 4 are only partly masked by said lid 15, for example, up to an edge 17 of the latter.

Figure 2:
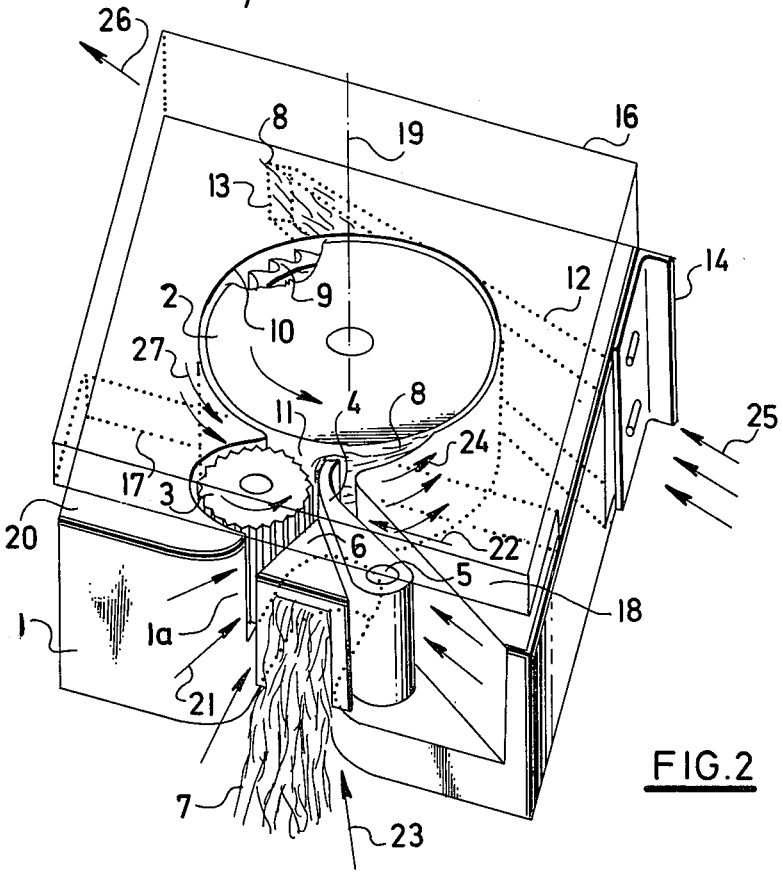
FIG. 2 is a perspective view of a second embodiment of the apparatus.

Another embodiment of the lid is shown in FIG. 2, wherein the lid 16 has an overlapping portion 18 provided by recessing the marginal edge of the lid 16 above the fiber feeding device. Thus the front side 20 of the housing 1 is made sufficiently accessible for air to be sucked thereinto. FIG. 2 additionally shows still another embodiment of the apparatus according to the invention, a projecting fiber feeding device, in which air is allowed to enter the device from all sides. In the embodiment of FIG. 2, the bottom of the housing includes a streamlined contoured portion 1a which enhances the flow of the incoming air.

FIG. 1 indicates directions of air flows entering the cavity 10 via the recess 11 of the fiber feeding device and flowing through the fiber separating device. The recess 11 accommodating the fiber feeding device comprising the feed roller 3, the pressure shoe 4 and the sliver condenser 6, is supplied with air flowing in the direction 21 normal to the axis of rotation 19 of the combing-out cylinder 2, or in the direction 23 substantially parallel, or in the direction 22 generally oblique relative to said axis 19. These directions are illustrated by arrows in the drawing. The air flow entering through the recess 11 is combined with an air flow 27 carried along by the clothing 9 of the combing-out cylinder 2 and produces an air flow 24 joining, in the fiber supplying duct 12, another air flow 25 entering said duct 12 from the ambient atmosphere via the throttling baffle 14. In this way a resulting air flow 26 arises and is sucked into the not shown yarn twisting device of any subatmospheric pressure operable type.

In operation, the fibrous sliver 7 is condensed, before entering the apparatus, to a substantially flat formation and is positively supplied by the feed roller 3 in cooperation with the pressure shoe 4 to the operating zone of the sawtooth clothing 9 of the combing-out cylinder 2. The separated fibers 8 are carried away by said clothing 9 and by the air flow 24 into the supply duct 12 and then therethrough by the resulting air flow 26 into the yarn twisting device. As hereinabove set forth in the introductory part of the specification, the lids of the well-known prior art constructions cover the whole front side 20 of the fiber separating device, thus making the sliver supply recess 11 dust-tight. In contradistinction thereto, in the apparatus according to the invention, the recess 11 is formed in such a way that the air has free access to pass in the directions 21, 22 and 23. By appropriately adjusting the throttling baffle 14 at the intake of the supply duct 12, there can be achieved an intense air streaming through the fiber feeding device, a higher velocity being obtained for the air flow 24 and thereby a uniform acceleration of fibers 8 on their way from the feeding device up to the outlet port 13 of the fiber supply duct of the fiber separating device can also be effected.

It is evident that by the aforementioned intense air streaming the recess 11 is prevented from being clogged by fibers, fiber particles, various admixtures and dust; such materials, especially in well-known highly productive open-end spinning units, accumulate excessively in the fiber supply recess 11; consequently, the recess is fouled and finally the contaminants enter the actual spinning process, which results in yarn breakages, or low yarn quality. This is efficiently prevented by the intense air flowing in the directions 21, 22 and 23. Moreover, by uncovering the front part of the feed roller 3 and by scavenging the same by air, the roller 3 is prevented from being choked. Thereby another enhancement of the spinning process quality is attained.

Although the invention has been illustrated and described with reference to a plurality of preferred embodiments thereof, it is to be expressly understood that it is in no way limited to the disclosure of such a plurality of embodiments, but is capable of numerous modifications within the scope of the appended claims.

What is claimed is:

1. An improved method of separating fibers from a fibrous sliver and supplying the separated fibers to a twist forming element of an open-end spinning unit, comprising the steps of exposing the fibers in a fiber separating zone, formed in the annular space between a combing-out cylinder and the bore of a housing, to a flow of sucked in air; said housing also forming a sliver feeding zone adjacent said fiber separating zone;

the improvement being that said flow of sucked in air is the resultant of air flows in planes perpendicular to the axis of said combing-out cylinder, planes passing through said axis, and planes parallel to said axis.

2. The method of separating fibers as set forth in claim 1, wherein said sliver feeding zone has inlet and front ports, the air flowing through said ports being 10 – 70 percent of the total air entering the whole region of the fiber separating device.

3. A device for separating fibers from a fibrous sliver and for supplying the separated fibers to a twist forming element of an open-end spinning unit, comprising in combination, a housing having a bore and a cavity communicating with said bore;

a combing-out cylinder operatively axially mounted in said bore and defining an annular space between the cylinder and bore walls which forms a fiber separating zone;

a sliver feeding device having an inlet and operatively mounted in said cavity and adapted to feed a condensed sliver to said fiber separating zone;

means covering both ends of said bore and at least one of the sides of said housing, said means being constructed and shaped in such a way that ambient air has open access to at least a portion of said cavity housing said sliver feeding device and is sucked into said cavity during operation of the device.

4. The device as defined in claim 3, wherein said means has an opening which exposes the entire cavity housing the sliver feeding device.

5. The device as defined in claim 4, wherein the sum of cross-sectional areas of said opening of said means and the inlet of the sliver feeding device is from 10 – 70 percent of the total sum of cross-sectional areas of all the air supplying channels of the fiber separating device.

6. The device as set forth in claim 3, wherein said cover means comprise a mounted lid at the front side of the housing, said lid being recessed on the side facing the sliver feeding device to allow tha air to be sucked in.

* * * * *